US010502198B2

(12) United States Patent
Stumpf et al.

(10) Patent No.: US 10,502,198 B2
(45) Date of Patent: Dec. 10, 2019

(54) ACOUSTIC ATTENUATING DEVICE FOR COMPRESSORS

(71) Applicant: Whirlpool S.A., Sao Paulo (BR)

(72) Inventors: Cristiano Stumpf, Joinville (BR); Conrado Koppen, Joinville (BR); Roque Tadeu Miranda, Florianopolis (BR)

(73) Assignee: Embraco—Industria De Compressores E Solucoes Em Refrigeracao Ltda., Joinville (BR)

( * ) Notice: Subject to any disclaimer, the term of this patent is extended or adjusted under 35 U.S.C. 154(b) by 208 days.

(21) Appl. No.: 15/516,941

(22) PCT Filed: Oct. 6, 2015

(86) PCT No.: PCT/BR2015/050168

§ 371 (c)(1),
(2) Date: Apr. 5, 2017

(87) PCT Pub. No.: WO2016/054710

PCT Pub. Date: Apr. 14, 2016

(65) Prior Publication Data

US 2017/0248131 A1 Aug. 31, 2017

(30) Foreign Application Priority Data

Oct. 8, 2014 (BR) ..... 1020140251405

(51) Int. Cl.
*F04B 39/02* (2006.01)
*F04B 39/00* (2006.01)

(52) U.S. Cl.
CPC ..... *F04B 39/0061* (2013.01); *F04B 39/0072* (2013.01); *F04B 39/023* (2013.01)

(58) Field of Classification Search
CPC ..... F04B 39/0072; F01N 1/02
See application file for complete search history.

(56) References Cited

U.S. PATENT DOCUMENTS 5,201,640 A 4/1993 Heinzelmann et al. ..... 417/312
5,971,720 A 10/1999 Fagotti et al. ..... 417/312
(Continued)

FOREIGN PATENT DOCUMENTS

BR 102013019311-9 9/2015

*Primary Examiner* — Patrick Hamo
(74) *Attorney, Agent, or Firm* — Harrington & Smith

(57) ABSTRACT

Acoustic attenuating device for compressors which includes a hollow body having at least one input port, at least one output channel, at least one output port disposed in the at least one output channel, an intermediate body dividing the hollow body into two acoustic chambers, and a connection channel communicating the two acoustic chambers. Said connection channel includes two sub-channels, wherein one of the two sub-channels accommodates, at least partially, the output channel and the other one of the two sub-channels conforms fluid communication between the two acoustic chambers. The acoustic attenuating device further includes at least one blocker disposed between the outer side of the output channel and the inner side of the sub-channel which accommodates the output channel, wherein said blocker is capable of precluding flow between the two acoustic chambers, thereby reducing the amount of lubricating oil which flows out from the compressor into the cooling system.

3 Claims, 4 Drawing Sheets

(56) References Cited

U.S. PATENT DOCUMENTS

| | | | | |
|---|---|---|---|---|
| 6,415,888 | B2 * | 7/2002 | An | F01N 1/12 181/229 |
| 6,506,028 | B2 | 1/2003 | Silveira et al. | 417/312 |
| 2001/0050198 | A1 | 12/2001 | An et al. | 181/403 |
| 2005/0031461 | A1 | 2/2005 | Lilie et al. | 417/312 |
| 2009/0257892 | A1 | 10/2009 | Svendsen et al. | 417/312 |

* cited by examiner

ACOUSTIC ATTENUATING DEVICE FOR COMPRESSORS

FIELD OF THE INVENTION

The present invention refers to an acoustic attenuating device applied in hermetic compressors, preferably in reciprocating compressors usually used in cooling systems in general. More particularly, the present invention refers to an acoustic attenuating device comprising technical, structural and functional features capable of decrease the level of noise of hermetic compressors in a general way, but principally eliminate problems caused by drag oil together with refrigeration fluid inside the cooling system.

BACKGROUND OF THE INVENTION

As it is known by those skilled on the art, most part of the hermetic compressors, usually applied on cooling systems, comprises at least one acoustic attenuating device disposed inside the carcass, particularly on the suction line and/or exhaust line, being the main purpose of this device attenuate pumping pulses of coolant gas to reduce the hermetic compressor noise, and also thermally isolate the coolant fluid.

Just for clarification, this type of acoustic attenuating device can present different nomenclatures, specially, depending on its installation position related to the compression unit. For example, the terminology suction acoustic filter or suction muffler are usual when the referred attenuating device is positioned on the suction line, in a way to promote the coolant gas conduction from strainer on the direction of the suction valve. When said attenuating device is positioned after the compression unit, nomenclatures are adopted as expansion chamber or expansion muffler, or also can be named as exhaust chamber or exhaust muffler.

On this context, is it seen that the acoustic attenuators device applied in compressor well known on the prior art comprises constructive and functional configurations really complexes that affect, mainly, the production lines and compressors assembly and, consequently, of equipment and cooling systems in general. More particularly, appears that the devices from the prior art comprises structures of reduced dimensions which ends up requiring precision levels and components finishing substantially high to obtain the security in conducting and directing coolant gases, besides the acoustic attenuation and, eventually, on thermal isolation of these gases.

More specifically, it is known that these acoustic attenuating devices are formed by a hollow body in which are provided chambers and ducts for coolant gases circulation from, and to the compression unit. As it is broadly known by those skilled on the art, this gases circulation is caused by compression chamber pulse, which generates noise that are softened as the structural and geometrical features of ducts and chambers through which gases circulate, this is, the attenuation level of noises can be higher or lower according to the specificities and the constructive details of the acoustic attenuating device applied on the compressor.

On this context, as above highlighted, it can be said that this inconvenient are particularly related to structural aspects for manufacturing and assembling this chambers and coolant gases circulating ducts. This is because, this chambers and ducts are formed by several pieces and walls that should be fitted together in a way to obtain an adequate geometry of chambers and ducts for the correct acoustic attenuation inside the attenuating device.

However, in view of the quantity of inter-related pieces, there is an excessive number of interactions needed between pieces that ends up favoring internal leaks of gases, in other words, as should be known by those skilled on the art, as higher the number of interactions and connections between pieces, higher the risk of providing vulnerable regions and capable of causing leaks, affecting directly the levels of acoustic attenuation, but mainly the work conditions of the compressor.

For example, there are known on the prior art the documents US 2005/0031461, U.S. Pat. Nos. 5,201,640, 5,971,720 and 6,506,028, that reveal models of acoustic attenuating devices developed for applying in hermetic compressors. Despite being functional, this models of device presents inconvenient related to the sealing level between the internal chambers and formed ducts, once this sealing are obtained just by material interference contact, what needs really precise geometry and, consequently, affecting the production line.

Another inconvenient of these devices from the prior art is related to the configuration and shaping of internal ducts for gas circulation, which ends up needing applying some intermediate further pieces to form an acoustic filter for attenuating properly the pulses coming from the compression system, causing determined excitation to the compressor set that, in the end, when functioning, will have a determined acoustic behavior (perceptible to human being) that in real is a noise spectrum because of frequency. As a result, it is needed an increase on the number of sealing between components, affecting directly projects and manufacturing and assembly costs of these devices.

In order to solve the most part of the inconvenient above related, it was developed an acoustic attenuating device, which is also the object of patent document BR102013019311-9 filed by the Applicant itself. More particularly, this attenuating device managed satisfactorily solve the inconvenient observed on production lines, as well as the attenuation levels of pulses coming from the gas compression system.

The device developed and defined by the patent document from the applicant itself achieved these objectives because of the concentric pipes disposal applied for connection between the acoustic chambers and the hollow body that forms the attenuating device. More specifically, said acoustic chambers are formed by the disposal of an intermediate element, which is formed by a platform having at least one connection channel that is fluidly connected between the acoustic chambers and surrounds the output channel that is connected to the output port.

As should be appreciated by those skilled on the art, and as explored on document BR102013019311-9, this concentrically relation between the connection channel and the gas output channel, in order to obtain the proper geometry of the chambers, ducts and volume inside the muffler to correct acoustic attenuation.

Despite showing very functional referring to noise attenuation and, mainly, simplifying the manufacturing and assembly lines of acoustic attenuating devices, in practice, it was seen the possibility of further improve this type of device, particularly in reference of the control of said "external circulation of oil"—CEO and, also, improve acoustic attenuation levels.

As should be known by those skilled on the art, this CEO is the percentage of pumping oil together with the coolant fluid inside the cooling system, once that, inside of the compressor has bearing lubricating oil. In case this percentage of CEO exceed a predetermined value, the level of oil inside the compressor can decrease and, with this, endangers the integrity of functional components of compressor, in view of the low index of lubricating.

An alternative that was seen to compensate the increase of CEO percentage would be increase the quantity of oil inside the compressor. However, this solution does not seem profitable in view of the increase on the compressor final costs, in addition to let it next to the electrical engine that may cause noise increase. Another problem in increasing the amount of oil on the compressor is provide the inflow of oil on the suction chamber, that would cause blow liquid and compressor break.

Particularly related to the attenuating device model, according to object of patent BR102013019311-9, in some moments during the functioning, this percentage reached higher levels due to concentric disposal of connection channels and output, once such disposal generated a region between surfaces that facilitated conduction of oil to the cooling system.

This concentric condition favors oil pumping, once the fluid flow strength by contemplated region between the intermediate pipe and by the pipe connected directly on the headstock, which in turn has the lower pressure values inside the chamber. Other constructions has also advantage related to oil purge from inside the chamber comparing to this construction due to the distance between the pathways that the fluid (coolant gas with oil) runs until finding the pipe connected directly to headstock.

This way, considering the above related, it is possible say that the acoustic attenuating devices for hermetic compressors, according to available knowledge of the prior art, presents limitation and constrains that affect directly the manufacturing and assembly of this type of device. Besides that, other models that solve these inconvenient apparently can be improved referring to functionality, and specially related to problems from the CEO percentage control.

OBJECTS OF THE INVENTION

It is worth clarifying that the acoustic attenuating device, object of the present invention, can be applied both in suction lines and in exhaust lines of hermetic compressors. Therefore, it is important to be clear that the follow description will mention simply the attenuating device, should be interpreted as broadly as possible, and independent of the positioning inside the compressors.

This way, it is an object of the present invention provide an attenuating device, particularly developed to be applied in hermetic compressors usually used on cooling systems being said device comprised by technical, structural and functional features capable of simplify its manufacturing process and increase noise attenuation levels, but mainly eliminate eventual inconvenient related to CEO percentage control.

More preferably, it is an object of the present invention provide an acoustic attenuating device for hermetic compressors whose chamber configuration and internal ducts promote safety control and maintenance of CEO percentage levels and, consequently, becomes impossible keep the oil level currently packed inside the compressors, without risking the lubricating parameters and functional components integrity of the compressor.

Still, it is an object of the invention, propose an acoustic attenuating device for hermetic compressors, in which channels and chambers comprises a configuration that allows gas circulation, but particularly is capable of increasing noise attenuation levels, specially, due to accommodation conditions of the output channel.

SUMMARY OF THE INVENTION

Thus, in order to achieve the objects and technical effects above mentioned, the present invention refers to an attenuating device for applying on suction and/or exhaust lines of hermetic compressors, being comprised by technical, structural and functional aspects for improving the noise reduction, but mainly eliminate problems with oil external circulation (CEO) percentage no the cooling system.

More particularly, and according to an embodiment of present invention, the attenuating device is comprised by an hollow body closed by a lid, to obtain an structure having at least one input port and one output port, wherein, internally, said structure is divided into at least two acoustic chambers (A, A') according to disposal of an intermediate body formed by a platform having a connection channel built by two sub-channels, wherein one of them is capable of accommodate totally the bottom part of the output channel. This output channel has on its body a peripheral protrusion responsible for promoting the blocking of said sub-channel.

According to an embodiment of the present invention, the remaining sub-channel of the connection channel is completely unobstructed allowing the coolant gas to circulate between the acoustic chambers.

Additionally, as one advantageous preferred embodiment of present invention, the bottom portion of said output channel is fully accommodated inside one of the sub-channels, preferentially, the end of this output channel should be recessed related to the end of the sub-channel where it is located.

According to an embodiment of acoustic attenuating device, object of present invention, the hollow body, the lid and the intermediate body are manufactured in low thermal conductivity material. Besides, fixing the edge of said hollow body with the edge of said lid, pressing and locking said intermediate body could be done using welds, glues, adhesives or mechanical locks.

Optionally, according to another possible embodiment of present invention, the acoustic attenuating device, object of present invention, can be set with a plurality of acoustic chambers, through the disposal of further adapters and intermediate bodies.

In addition, according to an optional embodiment of present invention, said lid and said output channel are manufactured in one piece or independently, when they will be connected and fixed later during assembly line of attenuating devices.

BRIEF DESCRIPTION OF THE DRAWINGS

The features, advantages and technical effects of present invention, as above mentioned, will be better understood by those skilled on the art from the following detailed description, which is merely an example, and not restrictive, of preferred embodiments of the invention, being made referring to appended schematic figures, in which.

DETAILED DESCRIPTION OF THE INVENTION

Thus, according to the schematic figures above mentioned, some examples of preferred and possible embodiments of present invention will be described more detailed next, however, it should be clear that is about a description merely exemplificative and not restrictive, once the present acoustic attenuating device for hermetic compressors of cooling systems in general, can present and comprise different details and technical, structural and sizing features without, with this, be apart from the protection scope.

Figure 1:
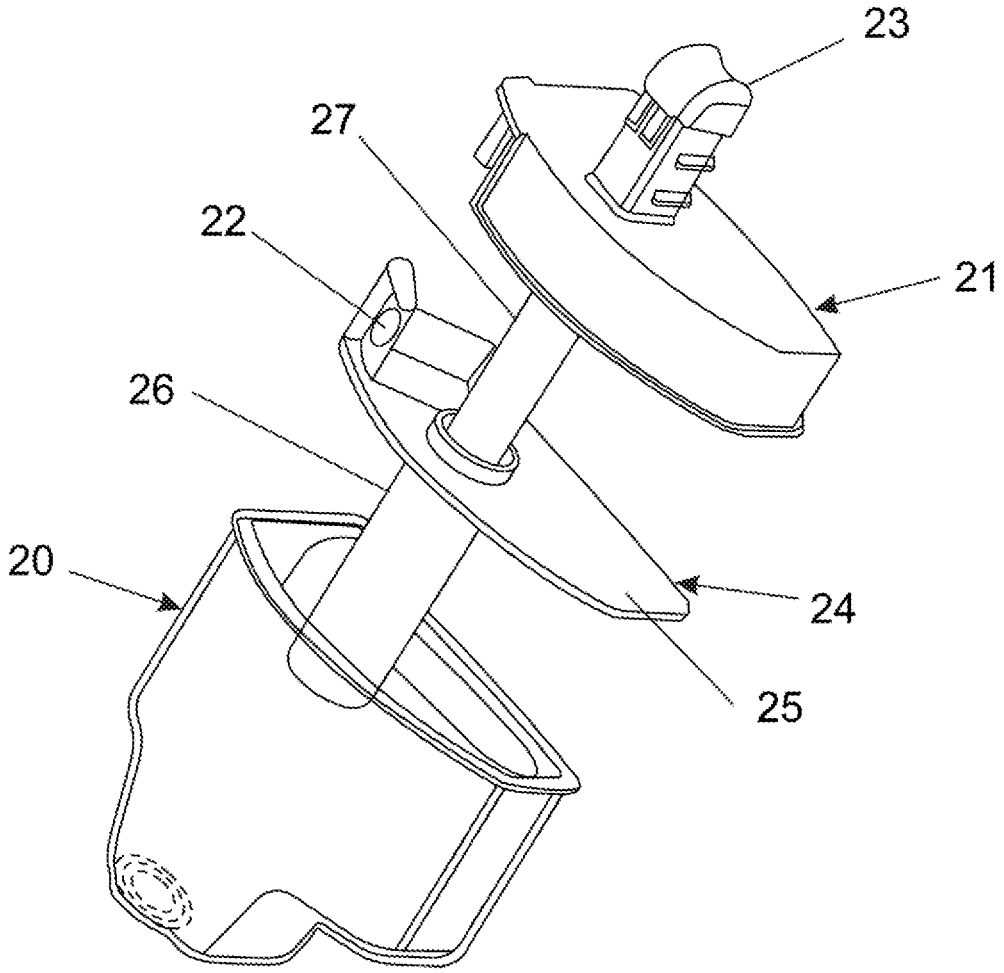
FIG.1 PRIOR ART
FIG. 1 shows an acoustic attenuating device for hermetic compressors, such as the known models of the prior art.

FIG. 1 presents an acoustic attenuating device, representing the prior art, such as the mentioned and defined on patent document BR102013019311-9, which is comprised, basically by an hollow body 20 closed by a lid 21, forming an structure having at least one input port 22 and an output port 23, wherein between said hollow body 20 and said lid 21 is disposed at least one intermediate body 24 dividing said structure for at least two acoustic chambers A, A'. As can be seen still referring to FIG. 1, said intermediate body 24 has a platform 25 having at least one connection channel 26 that fluidly communicates said acoustic chambers A, A' and, further, surrounds partially the output channel 27 that is connected to said output port 23 and, particularly fixed together with said lid 21.

Figure 2:
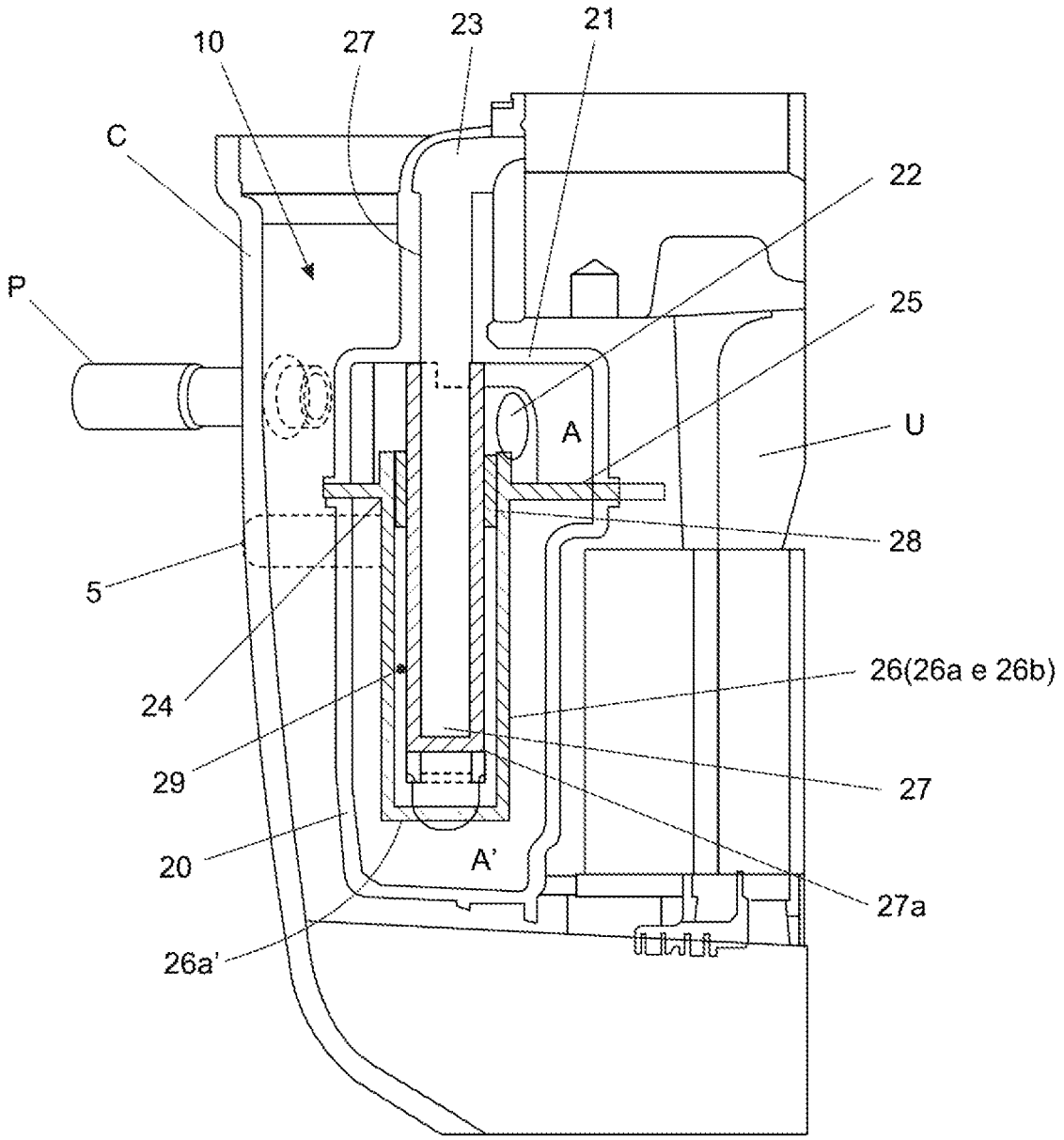
FIG. 2 shows a partial sectional view of a hermetic compressor having an acoustic attenuating device, according to one preferred embodiment of the present invention.
Figure 3A:
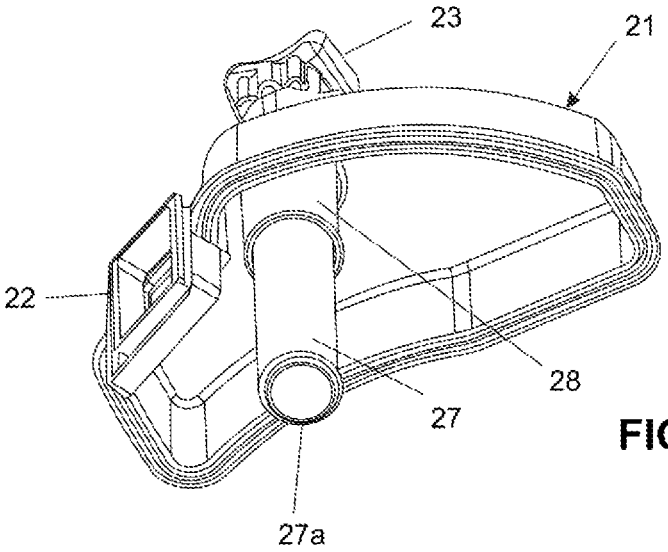
FIG. 3A shows the lid of the acoustic attenuating device structure, according to present invention.
Figure 3B:
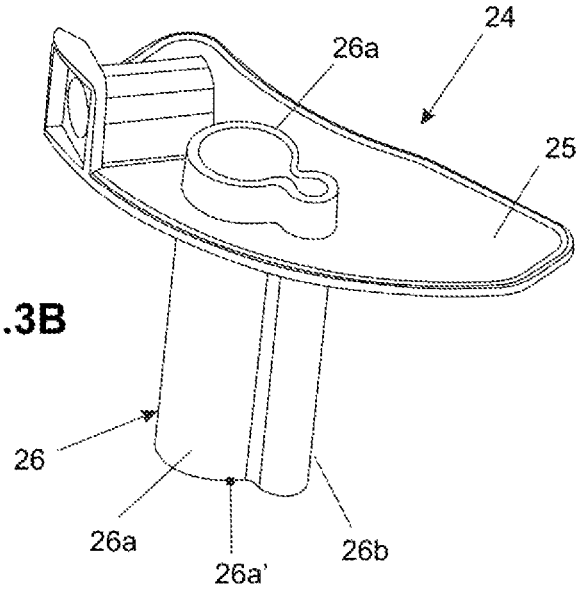
FIG. 3B shows the intermediate body of the acoustic attenuating device structure, according to present invention.
Figure 3C:
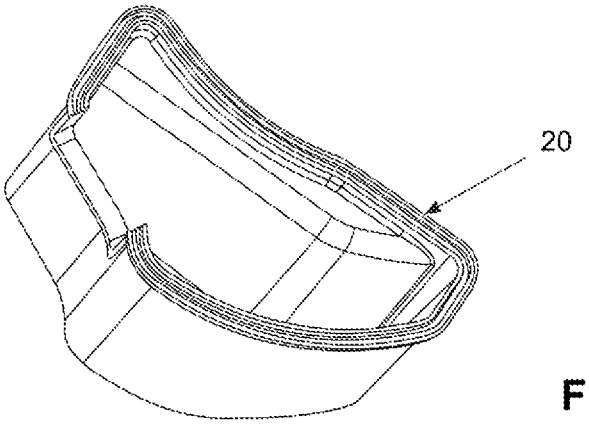
FIG. 3C shows the hollow body of the acoustic attenuating device structure, according to present invention.
Figure 4:
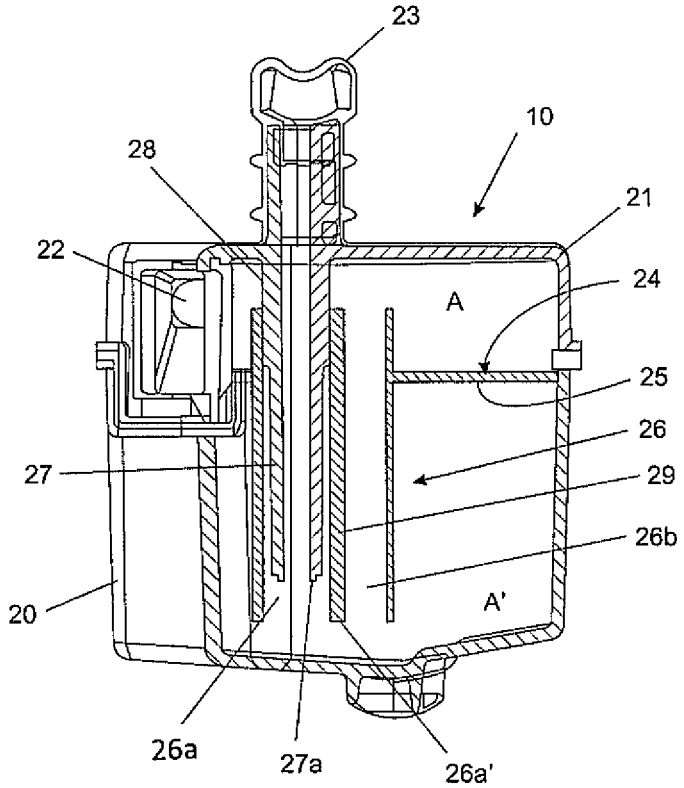
FIG. 4 shows a sectional view of the acoustic attenuating device structure, according to present invention.
Figure 5:
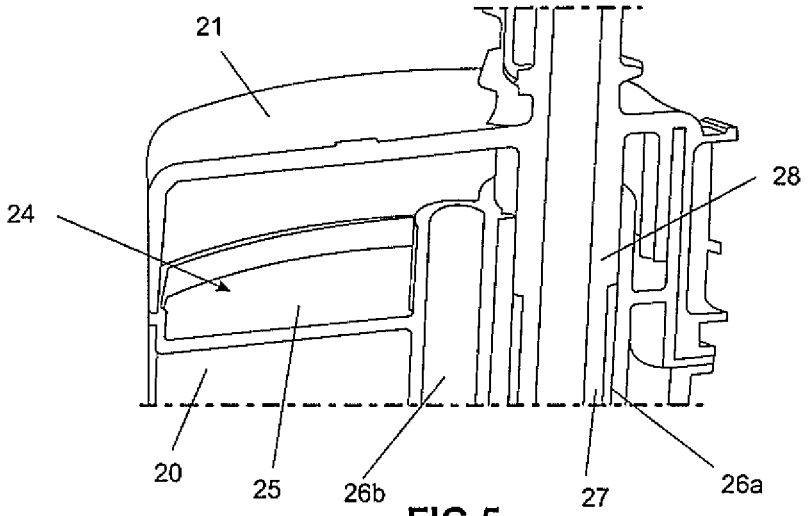
FIG. 5 shows a partial sectional view from the interaction and connection region between the structural components of the acoustic attenuating device, object of present invention.

FIG. 2 shows a partial sectional view of an hermetic compressor formed by a carcass C, wherein inside is accommodated the compression unit U having, conventionally, suction and exhaust valves to promote proper functioning of the cooling system. Said carcass C has, still, at least one throughout P that is connected at least to a suction line of the cooling system, as well as has an output S responsible for the connection with the exhaust line of the system.

The acoustic attenuating device 10, object of present invention, is particularly disposed inside the carcass C of hermetic compressor, connecting the suction or exhaust lines with the compression unit U. Worth reiterating that the device of present invention can be easily applied in any of the lines, either suction or exhaust, depending exclusively on the manufacturer's interests and projects. By way of representation, FIG. 2 presents an embodiment whose acoustic attenuating device 10 is installed together with the suction valve of compression unit U.

In this context, and as can be found, the attenuating device 10 resembles conceptually to those revealed on document BR102013019311-9, however, as will be evident from the following description, the attenuating device 10, object of present invention, comprises technical and structural aspects specific capable of improve substantially the work conditions of these devices, mainly by comprising elements that are capable of eliminate eventual risks with the problems of lack of control of CEO levels.

Thus, the acoustic attenuating device 10, according to present invention, also comprises a hollow body 20 closed by a lid 21, in a way to conform a structure having at least one input port 22 and one output port 23. Internally, said structure is divided in two acoustic chambers A, A' by means of an intermediate body 24 formed by a platform 25 which has a connection channel 26 having two sub-channels **26*a* and 26*b*, wherein one of this sub-channels, for example, the sub-channel 26*a*, accommodates fully the bottom part of the outlet channel 27**.

It is further provided a blocking means 28 disposed between the internal face of sub-channel **26*a* and the external face of output channel 27. In general, the blocking means 28 comprises a sealing element capable of precluding liquid fluid flow between internal face of sub-channel 26*a* and external face of output channel 27**.

According to one preferred embodiment of current invention, the blocking means 28 comprises a peripheral protrusion disposed on the bottom portion of output channel 27, and is responsible for blocking said sub-channel, in a way to allow the coolant gases to be conducted between such acoustic chambers A, A' only by the remaining sub-channel **26*b***.

On this condition, it is highlighted that the acoustic attenuating device 10, object of present invention can eliminate the risks of unwanted alteration of CEO percentage, wherein the pathway blocking between the two surfaces of output channel 27 and sub-channel **26*a*** eliminate the drawbacks caused by oil drag above the predetermined inside the cooling system and, with this, ensure the suitable and safety functioning of the compressor.

Furthermore, it is noted that the bottom portion of said output channel 27 is totally accommodate inside the sub-channel **26*a*, but mainly the end 27*a* of said output channel 27 still recessed related to the end 26*a*' of sub-channel 26*a*, namely, output channel 27 is packed and protected by sub-channel 26*a* walls and, with this, generate a kind of baffle chamber 29** that can provide the increase on the attenuation level of noise, given that such disposal provides the resonance Helmholtz effect.

As can be seen, forming said acoustic chambers A, A', as well as the channel where the gas flow is taken, do not present sealing complementary elements and/or complex structures that require manufacturing precision and connection between the components, in addition to present a considerably reduced number of element to structural forming of the attenuating device, when compared to those devices more traditional from the prior art.

Particularly, it is noted that leaking risks of gases on attenuating device of present invention, inside or outside are considerably reduced, mainly because the intermediate body 24 is fixed directly on the edge of the hollow body 20 and on the lid 21, allowing also the application of more effective means of external fixing, once it is about regions easily accessed after the assembly of the device as a whole. Unlike the more traditional prior art devices whose dividers and channels are positioned and interconnected inside the hollow body and must be secured to each other prior to the effective device assembly.

Further, because of the recessed disposal of the output channel 27 in relation to the sub-channel **26*a***, is achieved greater control over the CEO percentage and consequently provide a much more precise and optimized quantity of oil within the compressor, which certainly will lead in reduction of costs and benefits in production lines and maintenance of the compressor.

According to preferred embodiments of the present invention, the components of the attenuating device 10 are made of a low thermal conductivity material, to reduce the impact on gas properties and, consequently, the refrigeration system efficiency generally. Furthermore, the fixing of the edge of the hollow body 20 with the edge of said lid 21, compressing and locking the intermediate body 24 can be accomplished by any known means, e.g., welds, glues, adhesives, mechanical interlocks, etc.

Although the present description and figures make reference only to the embodiments formed by two acoustic chambers (A, A'), the attenuating device according to the present invention is not restricted to this configuration and it may eventually be configured with a plurality of acoustic chambers, and to do so, just the combination and arrangement of intermediate adapters and intermediate bodies additional 24, providing that keep blocked the passage between the surfaces of the output channel 27 with the sub-channels 26*a* and the recessed arrangement between the ends of those channels.

Additionally, said output channel 27, according to a preferred embodiment of the present invention is manufactured together with said lid 21, i.e., said lid 21 and said output channel 27 are manufactured in one piece. Optionally, and as should be appreciated by the skilled in the art, these components can be manufactured independently and then connected during the assembly process of the attenuating device, object of the present invention.

Finally, before all presented above, it should be clear that the present description is intended solely define exemplary preferred embodiments of the attenuating device according to the present invention, which are designed to compressor preferentially used on cooling systems in general. Therefore, as well as the skilled in the art comprises, numerous modifications are possible, variations and constructive combination of elements that perform the same substantially function to achieve the same results, which should be included within the scope of protection defined by the appended claims.

The invention claimed is:

1. Acoustic attenuating device for compressor, comprising:

a hollow body shaping a structure having at least one input port, at least one output channel and at least one output port disposed in at least one output channel;

said structure defining at least two acoustic chambers, which are defined by at least one intermediate body;

said intermediate body being shaped by a platform that has a connection channel capable of conforming fluid communication between the at least two acoustic chambers;

said connection channel being built by at least a first sub-channel and a second sub-channel;

at least one among the at least a first sub-channel and a second sub-channel accommodates, at least partially, the output channel;

the acoustic attenuating device for compressors being specially characterized by still comprising at least one blocking means disposed between at least a first sub-channel and a second sub-channel and the output channel;

wherein the blocking means comprises a sealing element capable of blocking the flow of liquid flow between the internal side of at least a first sub-channel and a second sub-channel and the external side of the output channel;

wherein the blocking means comprises a peripheral protrusion disposed on the external side of the output channel.

2. Acoustic attenuating device for compressor, according to claim 1, wherein the bottom portion of said output channel is totally accommodated inside the first sub-channel.

3. Acoustic attenuating device for compressor, according to claim 1, wherein the end of said output channel is recessed relative to the end of the first sub-channel.

* * * * *